US008677531B2

(12) United States Patent
Popitz

(10) Patent No.: US 8,677,531 B2
(45) Date of Patent: Mar. 25, 2014

(54) PILLOW FOR FACILITATING THE LATERAL SNIFF POSITION FOR IMPROVED AIRWAY MANAGEMENT

(75) Inventor: Michael D. Popitz, Marion, MA (US)

(73) Assignee: Michael D. Poptiz, Marion, MA (US)

( * ) Notice: Subject to any disclaimer, the term of this patent is extended or adjusted under 35 U.S.C. 154(b) by 351 days.

(21) Appl. No.: 13/006,850

(22) Filed: Jan. 14, 2011

(65) Prior Publication Data

US 2012/0180220 A1 Jul. 19, 2012

(51) Int. Cl.
*A47C 20/00* (2006.01)

(52) U.S. Cl.
USPC ..... 5/638; 5/636; 5/632; 5/630

(58) Field of Classification Search
USPC ..... 5/636, 638, 632, 630, 652, 622
See application file for complete search history.

(56) References Cited

U.S. PATENT DOCUMENTS

| | | | |
|---|---|---|---|
| 4,259,757 | A | 4/1981 | Watson |
| 4,918,774 | A | 4/1990 | Popitz |
| 5,018,231 | A | 5/1991 | Wang |
| 5,123,132 | A | 6/1992 | Dixon |
| 5,457,832 | A | 10/1995 | Tatum |
| 5,848,448 | A | 12/1998 | Boyd |
| 6,003,177 | A | 12/1999 | Ferris |
| 6,006,380 | A | 12/1999 | Sramek |
| 6,471,726 | B2 | 10/2002 | Wang |
| 6,539,567 | B1 | 4/2003 | Bae |
| 6,629,324 | B1 | 10/2003 | Shapiro |
| 6,742,207 | B1 | 6/2004 | Brown |
| 6,817,049 | B1 | 11/2004 | Hall |
| 6,915,539 | B2 | 7/2005 | Rathbun |
| 7,100,227 | B2 | 9/2006 | Frisbee |
| 7,316,041 | B2 | 1/2008 | Guez |
| 2002/0050007 | A1 | 5/2002 | Kim |
| 2008/0134437 | A1 | 6/2008 | Small |

OTHER PUBLICATIONS

Brookstone Anti-Snore Pillow as advertised on www.brookstone.com, retrieved Apr. 12, 2011 (2 pages).
Contour CPAP Pillow as advertised on www.contourliving.com, retrieved Dec. 14, 2010 (4 pages).

*Primary Examiner* — Peter M Cuomo
*Assistant Examiner* — Brittany Wilson
(74) *Attorney, Agent, or Firm* — Sterne, Kessler, Goldstein & Fox P.L.L.C.

(57) ABSTRACT

An apparatus for supporting the head and neck of a user for airway management includes a head-supporting surface dimensioned to receive and support the head of the user and a neck-supporting surface connected to the head-supporting surface, wherein the neck-supporting surface is dimensioned to receive and support the neck of the user; wherein the head-supporting surface and neck-supporting surface are configured so that when the user is lying on his or her side with a side of his or her head positioned on the head-supporting surface and a side of his or her neck on the neck-supporting surface, the user's head and neck are automatically aligned in the sniff position for improved airway management.

20 Claims, 9 Drawing Sheets

PILLOW FOR FACILITATING THE LATERAL SNIFF POSITION FOR IMPROVED AIRWAY MANAGEMENT

BACKGROUND

1. Field

The present invention relates to a pillow for aligning the oropharyngeal, laryngeal and tracheal axes of the human head for airway management while a user is in the lateral decubitus position.

2. Background Art

Many attempts have been made to improve pillows for increased support and comfort. Some pillows have been designed specifically to reduce snoring or other obstructive breathing or to facilitate intubation. Obstructive breathing may occur for example during sleep or sedation in the supine position. In this position, the effect of gravity upon the tongue tends to pull it towards the back of the oral cavity, thus increasing the possibility of obstructing the user's airway. Examples of pillows designed to reduce obstructive breathing include U.S. Pat. Nos. 4,918,774 and 5,048,136. As described in these patents, one method of opening the airway requires aligning the oropharyngeal, laryngeal and tracheal axes such that the straightest and largest diameter, and hence most unobstructed, airway passage is formed between the mouth and the larynx to improve the flow of air for airway management.

This alignment of the oropharyngeal, laryngeal and tracheal axes is commonly known as the "sniff" position and has been determined to be the most effective position for improved airway flow. The sniff position can be achieved while a user is on his or her back in the supine position by elevating the head about 10 cm with a pad or towel placed beneath the occiput (while the user's shoulders remain on the supporting surface), flexing the neck, and extending the head at the atlanto-occipital joint, either by tilting the head backward with one hand or by pulling up on the mandible or lower jaw bone. The sniff position generally corresponds to maximal forward flexion of the lower cervical spine and maximal extension at the base of the skull/top of the cervical spine. The sniff position may also be achieved when the atlanto-occipital joint is at maximal extension.

BRIEF SUMMARY

Although several pillows are designed to place the user's head in the sniff position while the user is on his or her back, many users would prefer being able to lay on their side, which is also known as the lateral decubitus position. Accordingly, a need exists for an improved pillow design for aligning the oropharyngeal, laryngeal and tracheal axes of the head for airway management while a user is on his or her side.

In one embodiment, an apparatus for supporting the head and neck of a user for airway management includes a head-supporting surface dimensioned to receive and support the head of the user and a neck-supporting surface connected to the head-supporting surface, wherein the neck-supporting surface is dimensioned to receive and support the neck of the user; wherein the head-supporting surface and neck-supporting surface are configured so that when the user is lying on his or her side with a side of his or her head positioned on the head-supporting surface and a side of his or her neck on the neck-supporting surface, the user's head and neck are automatically aligned in the sniff position for improved airway management.

In another embodiment, an apparatus for supporting the head and neck of a user for airway management includes a top surface; a bottom surface located on a side opposite the top surface; a first head-supporting surface dimensioned to support the head of the user; a second head-supporting surface dimensioned to support the head of the user; a first neck-supporting surface connected to the first head-supporting surface, wherein the first neck-supporting surface is dimensioned to support the neck of the user; a second neck-supporting surface connected to the second head-supporting surface, wherein the second neck-supporting surface is dimensioned to support the neck of the user; wherein the first head-supporting surface is configured to accommodate the user's head in a lateral decubitus position on the user's right side; wherein the second head-supporting surface is configured to accommodate the user's head in a lateral decubitus position on the user's left side; and wherein both first and second head-supporting surfaces and both first and second neck-supporting surfaces are respectively dimensioned relative to each other to align the oropharyngeal, the laryngeal and the tracheal airway axes of the user in the lateral sniff position when the user's head and neck are positioned upon the pillow in one of the first or second head- and neck-supporting surfaces.

In another embodiment, an apparatus for supporting the head and neck of a user for airway management includes a head-supporting surface dimensioned to support a side of the head of the user and a neck-supporting surface dimensioned to support a side of the neck of the user; wherein the depth of a recessed portion of the head-supporting surface corresponding to the user's chin is approximately 0.75 inches, the depth of a recessed portion of the head-supporting surface corresponding to the user's face is approximately 0.5 inches, and the depth of a recessed portion of the head-supporting surface corresponding to the back of the user's head is approximately 1 inch.

Further embodiments, features, and advantages of the present invention, as well as the structure and operation of the various embodiments of the present invention, are described in detail below with reference to the accompanying drawing.

BRIEF DESCRIPTION OF THE DRAWINGS/FIGURES

The accompanying figures, which are incorporated herein and form part of the specification, illustrate various embodiments of a pillow for facilitating the lateral sniff position for facilitating airway management. Together with the description, the figures further serve to explain the principles of the pillow described herein and thereby enable a person skilled in the pertinent art to make and use the pillow.

DETAILED DESCRIPTION

Figure 1:
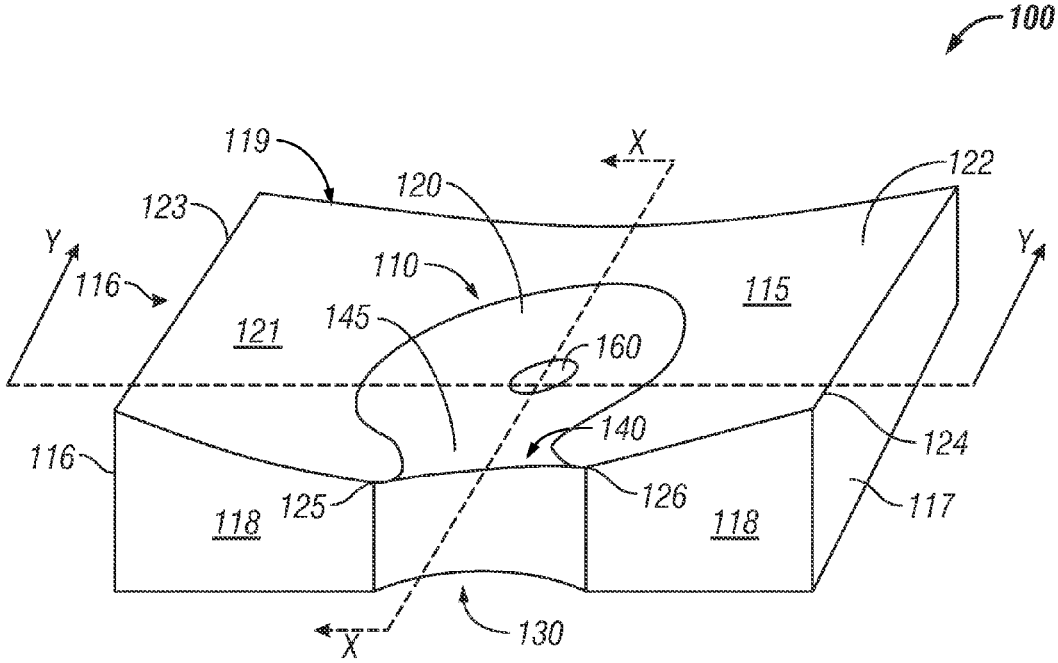
FIG. 1 is a top perspective view of a first embodiment of the present invention.

Reference will now be made in detail to embodiments of the present invention with reference to the accompanying figures, in which like reference numerals indicate like elements. Also, in the figures, the leftmost digit of each reference number corresponds to the figure in which the reference number is first used. While specific configurations and arrangements are discussed, it should be understood that this is for illustrative purposes only.

The present invention relates to a pillow for aligning the oropharyngeal, laryngeal and tracheal axes of the human head for airway management while a user is in the lateral decubitus position. Conventionally, a pillow is an apparatus for supporting a user's head and neck during sleep or rest. Airway management can involve adjusting the position of a user's head and neck for improved oxygenation, ventilation, respiration, or all three. By adjusting the position of a user's head and neck, the user can experience improved sleep, self oxygenation, and/or inhalation during intubation or rest in order to avoid airway obstruction that may result for example in snoring. Some embodiments of the present invention are directed to such a conventional pillow, whereas other embodiments are directed to a pillow that generally provides support for a user's head and neck during other activities.

FIG. 1 is a top perspective view of a first embodiment of the present invention. The pillow of FIG. 1 is for a right-side sleeper having a height ranging between 5'8" and 6'4", and a weight ranging between 140 and 250 lbs. This pillow would be sized "average." The dimensions hereinafter described for the pillow disclosed in FIGS. 1-12 are for a size "average" pillow. For a larger or smaller sized pillow, the dimensions would be increased or decreased, respectively, to accommodate the head, neck, and shoulder anatomy of a user of that size, the same being known to one of ordinary skill in the art. Pillow 100 has a height, width and depth that define a top surface 115, a bottom surface (not shown), a left side 116, a right side 117, a front surface 118, and a rear surface 119. Pillow 100 is generally rectangular-shaped when viewed from the perspective view of FIG. 1. For an average sized pillow, the length between left side 116 and right side 117 is approximately 20 inches. The length between front surface 118 and rear surface 119 is approximately 15 inches. Top surface 115 includes a downwardly sloping left side surface 121, a downwardly sloping right side surface 122, and a head recess 110. Downwardly sloping left side surface 121 slopes or extends downwardly from edge 123, which is approximately 6 inches high, towards point 125 surrounding head recess 110 and neck recess 140, wherein point 125 is approximately 4 inches high. The angle of this downward slope is approximately 10-12°. Similarly, downwardly sloping right side surface 122 slopes or extends downwardly from edge 124, which is approximately 6 inches high from the bottom surface of pillow 100 to point 126, which is also approximately 4 inches high from the bottom surface of pillow 100. The angle of this downward slope is approximately 10-12°. Alternative embodiments of pillow 100 may include rounded edges, or can be any other suitable shape. In another embodiment, a left-side sleeper is a mirror image of pillow 100.

Pillow 100 further includes a shoulder recess 130 and a neck recess 140. Shoulder recess 130 is molded into front surface 118. Pillow 100 is configured to allow a user to comfortably place his or her shoulder into shoulder recess 130, which is adapted for receiving either a left or right shoulder of the user. For an average sized pillow, shoulder recess 130 is approximately 10 inches wide and 4 inches deep with respect to front surface 118 of pillow 100 to provide adequate room for the shoulder to ensure proper alignment of the user's body as discussed herein with respect to FIG. 6.

Shoulder recess 130 joins with neck recess 140, which forms a channel in top surface 115 approximately 6 inches wide with respect to the front surface and approximately ¾ of an inch to 1 inch deep with respect to top surface 115. In another embodiment, the channel is approximately 2 inches deep with respect to top surface 115. Neck recess 140 is adapted to gently receive and cradle the user's neck in an anterior or forward flexion of the cervical spine, including cervical vertebrae C1-C7. Neck recess 140 joins with head recess 110, which is designed to gently receive and cradle the user's head and to orient the user's head into the sniff position, as discussed below with respect to FIG. 6.

In the embodiment shown in FIG. 1, pillow 100 includes ear-receiving opening 160 disposed within head recess 110, which is dimensioned to accommodate the user's ear while the user is lying on his or her side. Ear-receiving opening 160 is adapted to allow the user's ear to be free from pressure due to the pillow. Further, ear-receiving opening 160 may include a ventilation hole and channel (not shown) that passes through pillow 100 to an outer surface of pillow 100 to allow for the escape of pressurized air, or flow of fresh ambient temperature air, as the user places his or her head on pillow 100. Ear-receiving opening 160 can be a channel, recess, deformation or any other suitable shape.

Figure 2:
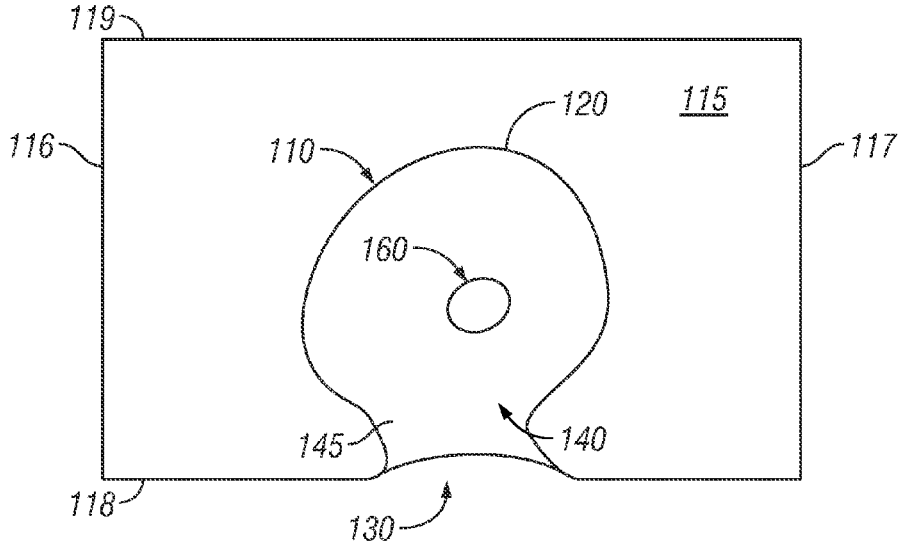
FIG. 2 is a top plan view of the pillow of FIG. 1.

Pillow 100 may preferably be made of a hypoallergenic, temperature sensitive, viscous elastic foam material. For example, pillow 100 may be made of polyurethane foam with a topmost layer of visco-elastic foam. The foam material may be convoluted or otherwise configured to evenly distribute pressure caused by pressure points of the user's head and neck. The foam material may have one or more different densities corresponding to different areas of the pillow. For example, head-supporting surface 120 within head recess 110, as shown in FIG. 2, may be comprised of a material having a density within the range of approximately 1.25 to 1.35 $lb/ft^3$ and preferably 1.30 $lb/ft^3$. Neck-supporting surface 145 within neck recess 140 may be may be made of a material having a higher or lower density from head-supporting surface 120, such as within the range of approximately 1.55 to 1.7 $lb/ft^3$ and preferably 1.62 $lb/ft^3$. Alternatively, neck-supporting surface 145 may be made from a single, unitary, piece of material that includes head-supporting surface 120. One example of a suitable convoluted foam material is available from E.R. Carpenter Company, Richmond, Va. Preferably any convolutions of the foam material would have a maximum depth of approximately 2 centimeters. In another embodiment, the convolutions are less than 2 centimeters. The convolutions may serve to maintain the user's position by increasing contact with the user and to minimize the impact of pressure points on the user.

Pillow 100 can be any suitable size including, but not limited to, sizes adapted fit any standard pillowcase, such as twin, queen or king size pillow cases. As previously discussed, the height of pillow 100 may vary according to the user. The optimal height will keep the cervical spine parallel to the surface upon which the user is laying down. For example, head-supporting surface 120 and neck-supporting surface 145 can be disposed in substantially such a way as to maintain the cervical spine in parallel alignment with the surface upon which the user lying. The resulting neutral lateral cervical spine alignment promotes an improved musculoskeletal well being. The surface upon which the user is lying defining a first plane, the head-supporting surface 120 is configured to put the center of the user's head sagittally in a second plane, and the neck-supporting surface 145 is configured to put the center of the user's neck sagittally in the second plane. Pillow 100 would be therefore adapted to ensure that these first and second planes are parallel to each other.

The dimensions of the pillow's shoulder recess, neck recess, and head recess will vary depending upon the size of the pillow. The size of the pillow will vary according to the size of the user, in particular the user's shoulder width and total body mass. However, other dimensions are possible so long as they achieve the same function. Further, the embodiments shown in the figures and described in this application can be reversed if desired. For example, FIG. 1 shows a pillow for facilitating the lateral sniff position for facilitating airway management configured to allow a user to lay on his or her right side. However, additional embodiments can be configured to allow a user to lay on his or her left side via the same or separate surfaces on the same side of the pillow, or alternatively on a separate surface on an opposite side or on a separate pillow.

Figure 3:
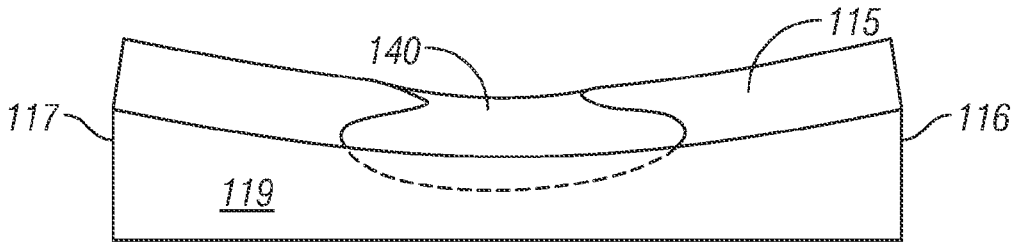
FIG. 3 is a back perspective view of the pillow of FIG. 1.
Figure 4:
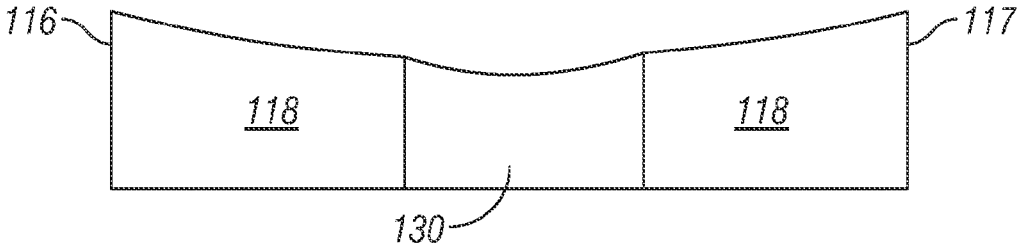
FIG. 4 is a front plan view of the pillow of FIG. 1.
Figure 5:
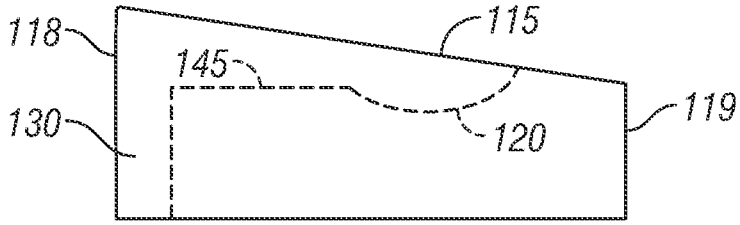
FIG. 5 is a right side plan view of the pillow of FIG. 1.

FIG. 2 shows a top view of pillow 100 including contour lines showing the contours of generally bowl-shaped head-supporting surface 120 and generally channel-shaped neck-supporting surface 145, which are discussed further with respect to FIGS. 6A-6C, 7A, and 7B. FIG. 3 is a back perspective view of pillow 100 showing portions of head recess 110 in phantom. FIG. 4 is a front plan view of pillow 100. FIG. 5 is a right side plan view of pillow 100, showing shoulder recess 130, neck-supporting surface 145, and head-supporting surface 120 in phantom. As shown in FIG. 5, pillow 100 is generally rectangular-shaped when viewed from the right end, with top surface 115 of pillow 100 sloping downward from a maximum height of approximately 6 inches at front surface 118 and reaching its minimum height of approximately 4 inches at back surface 119. Pillow 100 slopes downward from neck-supporting surface 145 to head-supporting surface 120. The left side plan view of pillow 100 is substantially identical to the right side plan view of pillow 100 as shown in FIG. 5. Other embodiments of the present invention can include a top surface having a consistent height, that is, without a downward slope from front surface 118 to back surface 119. Alternatively, other embodiments may have other suitable variable heights for top surface 115.

Figure 6A:
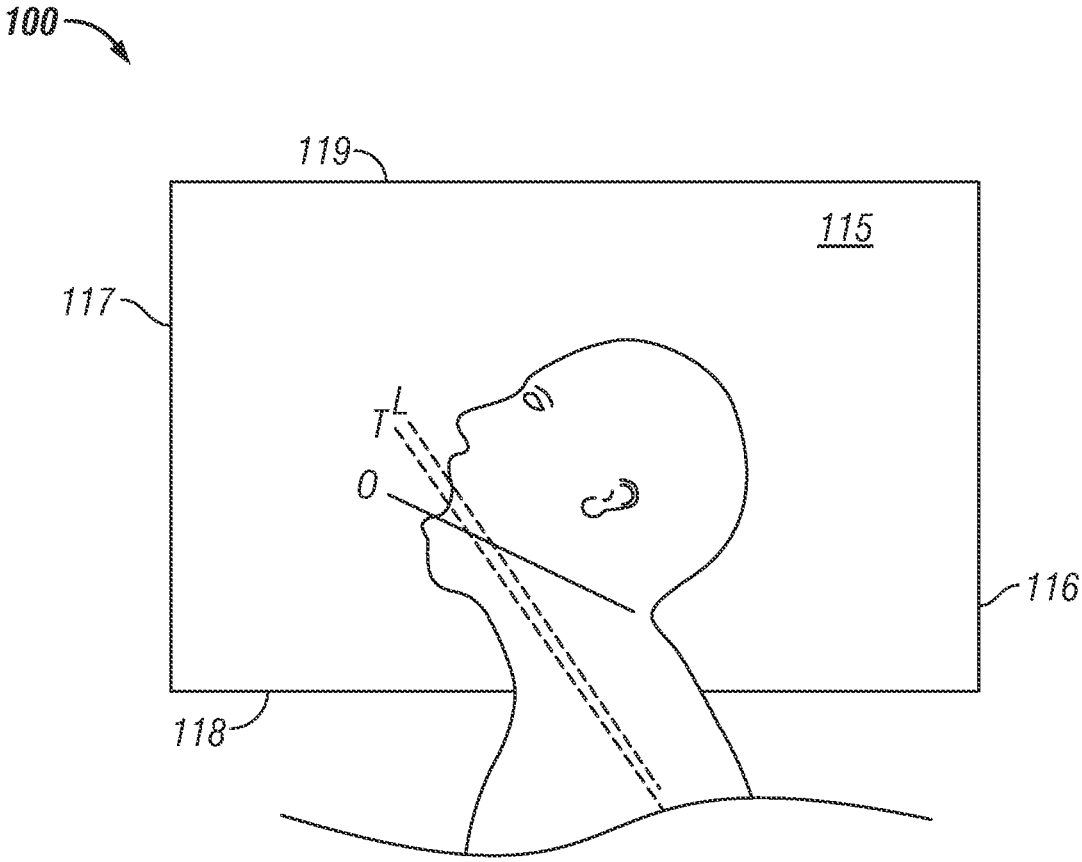
FIG. 6A is a top plan view of the pillow of FIG. 1 in use.
Figure 6B:
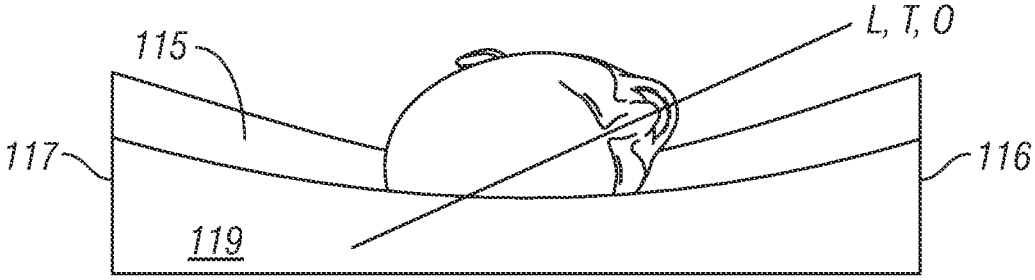
FIG. 6B is a back plan view of the pillow of FIG. 1 in use.
Figure 6C:
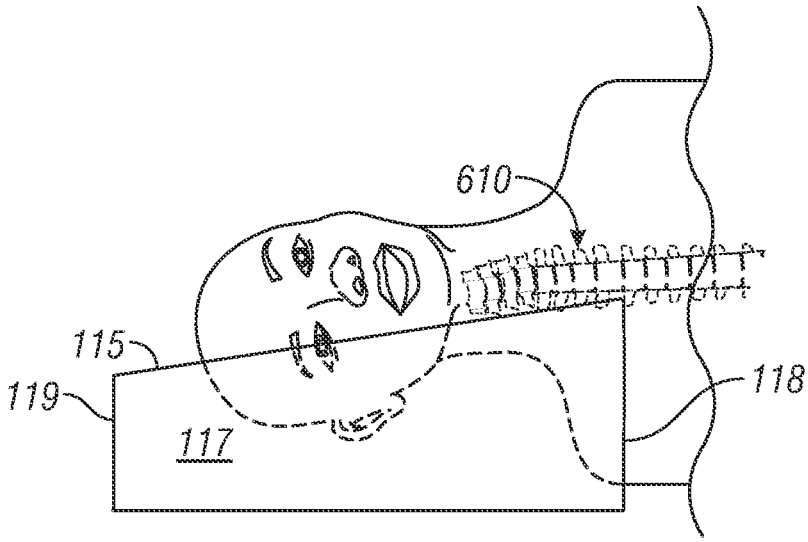
FIG. 6C is a left side view of the pillow of FIG. 1 in use.

FIGS. 6A, 6B, and 6C depict the pillow in use by a human user from a top view (FIG. 6A), a back view (FIG. 6B), and a left side view (FIG. 6C). FIG. 6C depicts portions of the user in phantom lines. Lines L, T, and O in 6A and 6B represent the laryngeal, tracheal, and oropharyngeal axes, respectively, of the user's head and neck. As shown in FIGS. 6A, 6B, and 6C, pillow 100 automatically aligns user's head to align these three axes accordingly, in order to put the user in the lateral sniff position. As shown therein, when in the sniff position, the user's chin and ear are approximately the same distance from front surface 118 of pillow 100. In such a position, the angle between a user's chest and neck is approximately 110°, whereas the angle between the user's neck and chin is approximately 160°. Further, the head-supporting surface 120 becomes more deeply recessed in the direction from front surface 118 to back surface 119 and in the direction from left side 116 to right side 117. This design specification is made in order for the head and neck to be in a neutral lateral position relative to the laying surface. As the head and neck are in a guided position in the anterior-posterior plane (that is, the sniff position), it is imperative for the musculoskeletal comfort of the user that the lateral plane be neutral. As shown in FIG. 6C, user's spine 610 is straight and parallel to the surface upon which the user is lying. The depth of the head-supporting surface should be deep enough to maintain the head easily in the location of the head recess, but not too deep as to overheat the head or encroach upon the airway or eyes. In an embodiment, the depth of the area of head recess 110 corresponding to the user's chin is 0.75 inches from top surface 115, the depth of the area of head recess 110 corresponding to the user's face is 0.5 inches from top surface 115, and the depth of the area of the head recess 110 corresponding to the back of the user's head is 1 inch from top surface 115. In an alternative embodiment (not shown), pillow 100 can include a chin ridge on head-supporting surface 120 or top surface 115 of the pillow to slightly elevate a user's chin from top surface 115 to provide additional chin lift, which may provide additional support to align the user's airway. An acceptable radius of curvature for the head recess is equal to 2.75 inches. An acceptable radius of curvature for the neck recess is equal to 2.3 inches.

Figure 7A:
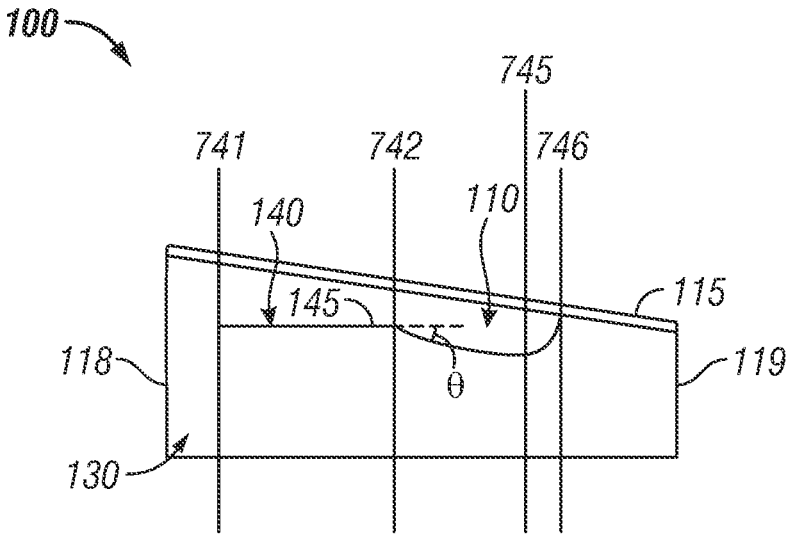
FIG. 7A depicts a cross-sectional view of the pillow of FIG. 1 along line X-X.
Figure 7B:
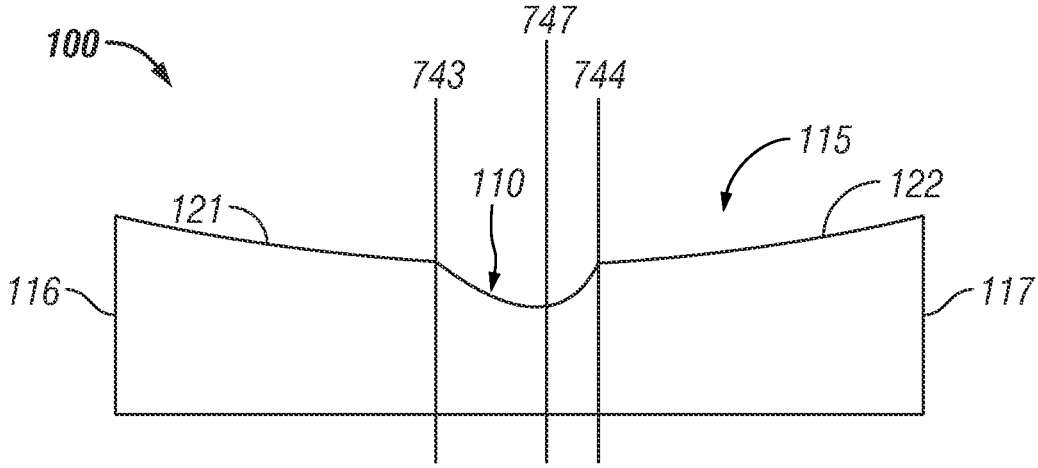
FIG. 7B depicts a cross-sectional view of the pillow of FIG. 1 along line Y-Y.

FIG. 7A depicts a cross-sectional view of the pillow of FIG. 1 along line X-X. As shown and described further with respect to FIG. 1 and its related description, pillow 100 includes shoulder recess 130 molded into front surface 118 and joins with neck recess 140 at plane 741. Neck recess 140 forms a channel in top surface 115 and in an embodiment can include a slight downward slope in the direction from front surface 118 to rear surface 119. Neck recess 140 joins with head recess 110 at plane 742. In an embodiment, the angle θ from the end of neck-supporting surface 145 at plane 742 and the head-supporting surface 120 at plane 745 is approximately 20°. Head-supporting surface 120 slopes downward from front surface 118 to rear surface 119, to orient the user's head into the sniff position, as discussed above with respect to FIG. 6. Head-supporting surface 120 slopes upward from plane 745 to plane 746 to support the top of user's head. FIG. 7B depicts a cross-sectional view of the pillow of FIG. 1 along line Y-Y. As shown and described further with respect to FIG. 1 and its related description, pillow 100 includes downward sloping left side surface 121 of top surface 115, which joins with head recess 110 at plane 743. In this embodiment, head-supporting surface 120 slopes downward from plane 743 to plane 744 to orient the user's head into the sniff position, as discussed above with respect to FIG. 6. Head recess 110 joins with downward sloping right side surface 122 of top surface 115 at plane 744. Head-supporting surface 120 slopes upward from plane 747 to plane 744 to support the top of user's head.

Figure 8:
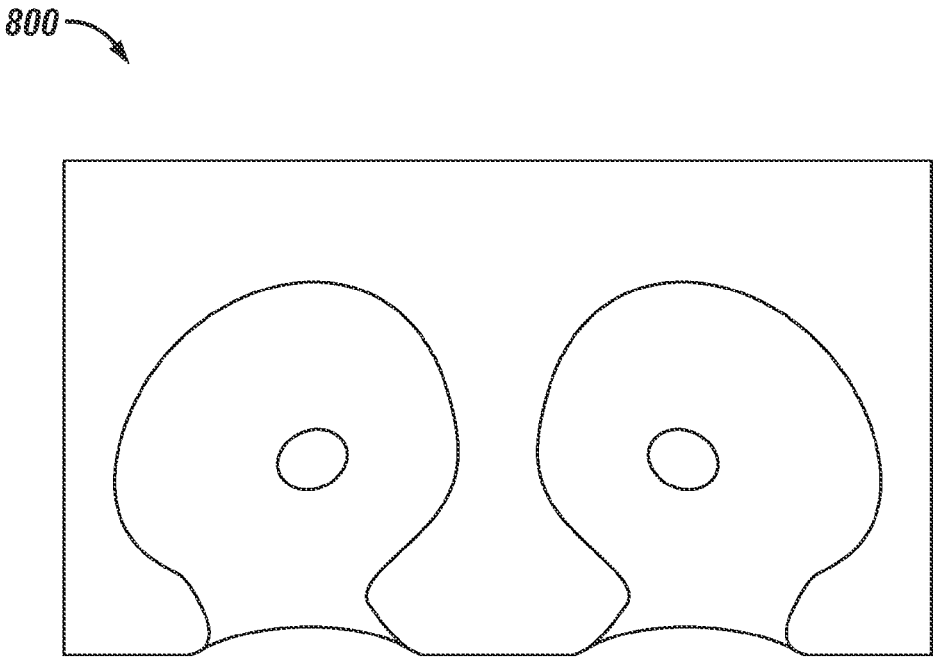
FIG. 8 is a top plan view of a second embodiment of the present invention.

FIG. 8 is a top view of a second embodiment of the present invention. Pillow 800 includes a second set of head, neck, and shoulder recesses configured in accordance with the embodiment of FIGS. 1-7, which allows a user to lay on either his or her left or right side on the same surface and end of the pillow. Both are dimensioned to put the user in the sniff position.

Figure 9:
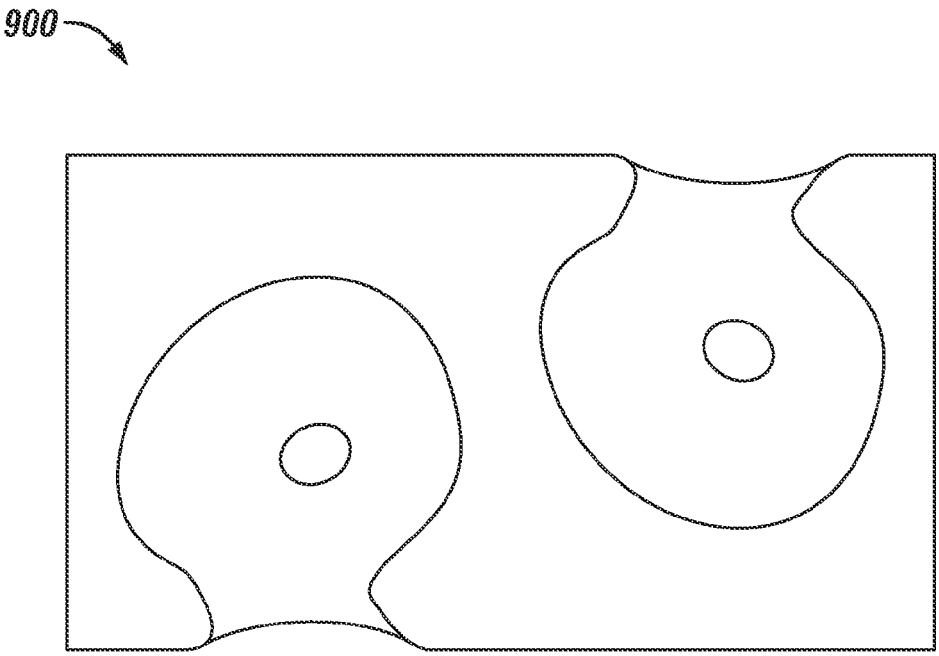
FIG. 9 is a top plan view of a third embodiment of the present invention.

FIG. 9 is a top view of a third embodiment of the present invention. Pillow 900 includes a second set of head, neck, and shoulder recesses configured in accordance with the embodiment of FIGS. 1-7, which allows a user to lay on either his or her left or right side on the same surface, but on different ends of the pillow. Both are dimensioned to put the user in the sniff position. This configuration allows a user to easily switch positions while lying down.

Figure 10A:
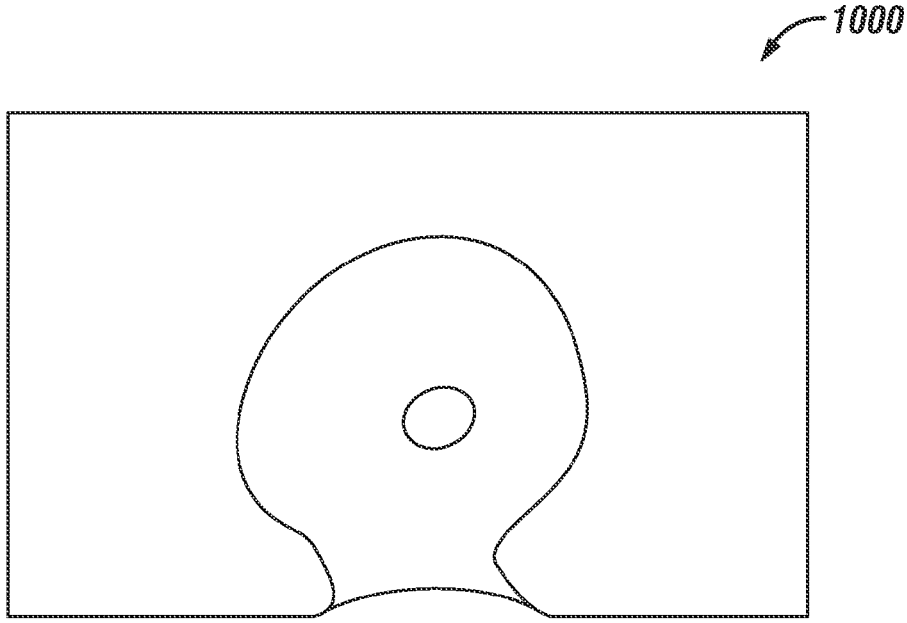
FIG. 10A is a top plan view of a fourth embodiment of the present invention.
Figure 10B:
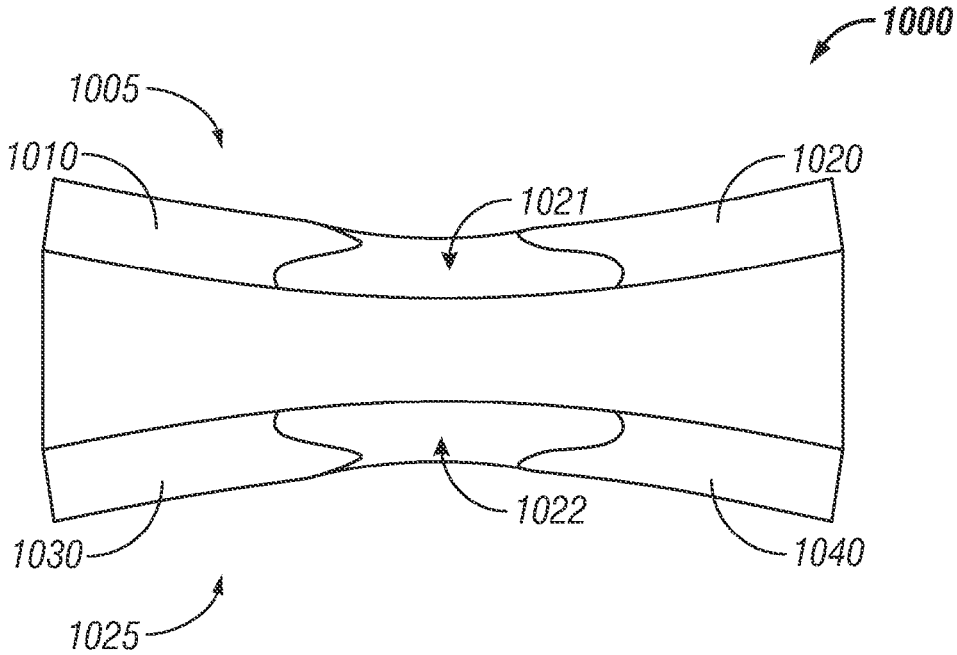
FIG. 10B is a front plan view of a fourth embodiment of the present invention.

FIG. 10A is a top view of a fourth embodiment of the present invention. Pillow 1000 includes a second set of head and neck recesses configured in accordance with the embodiment of FIGS. 1-7, which allows a user to lay on either his or her left or right side but on opposing surfaces of the pillow. The design of pillow 1000 shown in FIG. 10A provides the second head and neck recess on a second side of the pillow. If a user desires to lay on his or her other side, he or she can consciously flip over the pillow to change its orientation. FIG. 10B is a front view of pillow 1000. Pillow 1000 as shown in FIG. 10B includes first side surface 1005, which includes first head recess 1021, downward sloping left side surface 1010, and downward sloping right side surface 1020. Pillow 1000 further includes second side surface 1025 on the opposite side of pillow 1000 from first side surface 1005, which includes second head recess 1022, downward sloping left side surface 1040, and downward sloping right side surface 1030. In an embodiment, to increase stability of pillow 1000, first side surface 1005 and second side surface 1025 can be approximately horizontal, that is, without downward sloping surfaces from the front to rear surface. In an embodiment, first head recess 1021 and second head recess 1022 can be offset from one another in a horizontal direction in order to maximize pillow support under the head recess. In an embodiment, one or both of first side surface 1005 and second side surface 1025 are parallel to a horizontal sleeping surface in order to provide increased support for one or both of head recesses 1021 and 1022. Other suitable arrangements may be used to provide increased support for pillow 1000.

Figure 11:
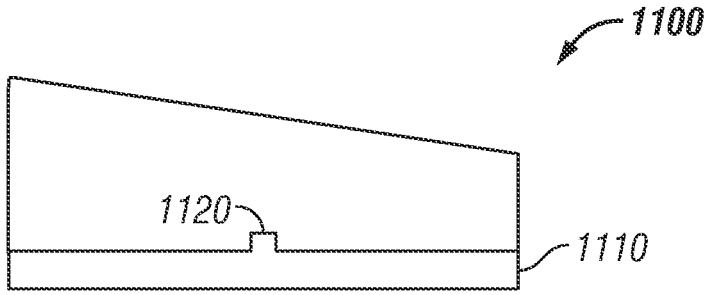
FIG. 11 is a right side view of a fifth embodiment of the present invention.

FIG. 11 is a right side view of a fifth embodiment of the present invention. Pillow 1100 includes a tongue-and-groove arrangement 1120, which allows it to interface with height extending pad 1110. Height extending pad 1110 may be the same size as the pillow in length and width or may have other suitable dimensions in order to preserve the functionality of pillow 1100. When height extending pad 1110 is coupled with pillow 1100, the height of pillow 1100 is increased to better accommodate the physiology of the larger user. The arrangement shown in FIG. 11 is only one example of a way to adjust the height of pillow 1100 according to the present invention. Alternatively, pillow 1100 may include a removable portion, such as breakaway sections on the bottom of the pillow that can be taken off to reduce the height of pillow 1100 by one, two, or more inches in order to allow more precise, semi-custom comfortable fit for the user. Pillow 1100 may further include or be replaced by any other permanent or non-permanent arrangement for changing the height of the pillow that would be apparent to a person having ordinary skill in the art.

Figure 12:
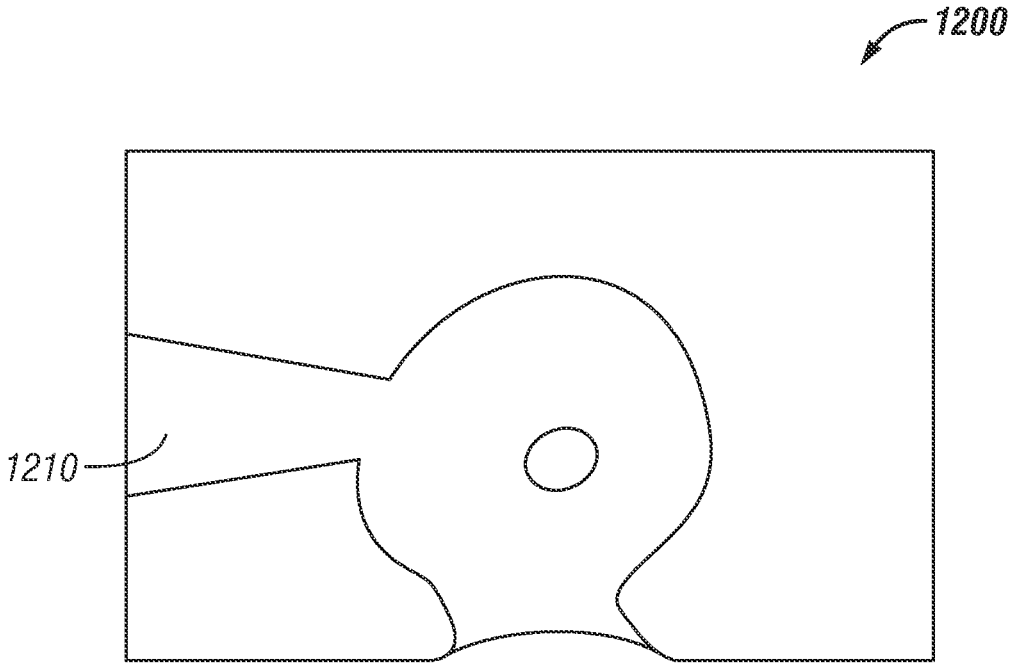
FIG. 12 is a top view of a sixth embodiment of the present invention.

FIG. 12 is a top view of a sixth embodiment of the present invention. Pillow 1200 includes vented breathing channel 1210, which is configured to facilitate a user's breathing when the user is lying on his or her side and the user's head is positioned in the recess. Vented breathing channel 1210 runs along the top of pillow 1200 and extends to the edge of pillow 1200, but may pass through pillow 1200 or may extend only part of the way to the edge of pillow 1200.

Figure 13:
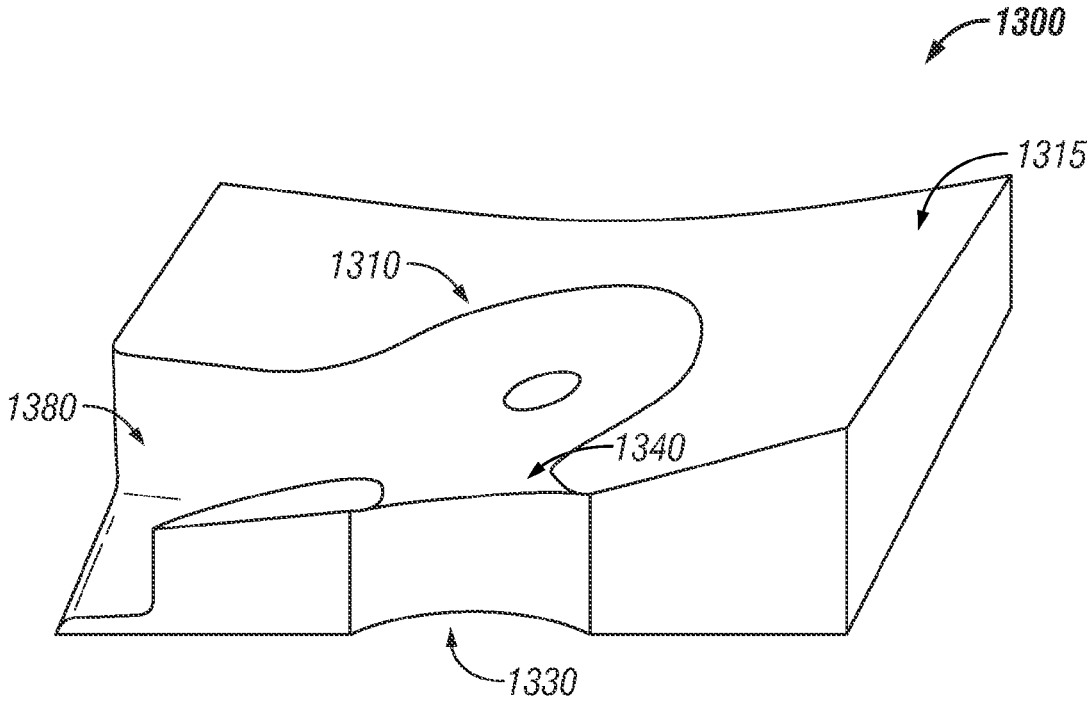
FIG. 13 is a top perspective view of a seventh embodiment of the present invention.

FIG. 13 is a top perspective view of a seventh embodiment of the present invention. Pillow 1300 includes head recess 1310, neck recess 1340, and mask recess 1380 formed in top surface 1315. Mask recess 1380 is sized to accommodate a breathing mask worn by the user and its associated tubing, such as a continuous positive airway pressure (CPAP) mask, a variable or bilevel positive airway pressure (VPAP/BiPAP) mask, and any other suitable mask or apparatus to facilitate breathing or provide supplemental oxygen.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. An apparatus for supporting the head and neck of a user in a lateral decubitus position to align and maintain a user's head and neck in the lateral sniff position, comprising:

a front surface;

a rear surface opposite the front surface;

a left side surface;

a right side surface opposite the left side surface;

a bottom surface;

a top surface opposite the bottom surface and having a left side that slopes downwardly from the left side surface toward a center of the top surface and a right side that slopes downwardly from the right side surface toward the center of the top surface;

a first recess formed in the top surface between the left sloping side and the right sloping side, the first recess having a chin supporting area for supporting a lateral side of a user's chin, a face supporting area for supporting a lateral side of a user's face, and a back portion supporting area for supporting a lateral side of a back portion of a user's head;

a second recess formed in the front surface for receiving a user's shoulder;

a third recess formed in the top surface and having a channel with a surface that extends between the second recess and the first recess for supporting a lateral side of a user's neck, wherein the channel is positioned at an angle with respect to the front surface such that when a lateral side of a user's neck is positioned on the surface of the channel, the lower cervical spine of a user is maintained in a position of substantially maximal forward flexion; and wherein the chin supporting area of the first recess is positioned at an angle with respect to the channel such that when a lateral side of a user's head is positioned in the first recess, the upper cervical spine of a user is maintained in a position of substantially maximal extension to align and maintain a user's head and neck in the lateral sniff position.

2. The apparatus of claim 1 further comprising a fourth recess formed in the top surface that extends from a side of the first recess to facilitate a user's breathing when a user is lying on his or her side and a lateral side of a user's head is positioned in the first recess.

3. The apparatus of claim 1, wherein the back portion supporting area of the first recess is approximately twice as deep as the face supporting area of the first recess.

4. The apparatus of claim 3, wherein the depth of the chin supporting area is approximately 0.75 inches, the depth of the face supporting area is approximately 0.5 inches, and the depth of the back portion supporting area is approximately 1.0 inch.

5. The apparatus of claim 1, wherein the first recess includes a sloped side wall in the chin supporting area that prevents a user's chin from falling toward his or her chest.

6. The apparatus of claim 1, wherein the first recess includes a sloped side wall in the back portion supporting area that prevents a back portion of a user's head from falling toward his or her back.

7. The apparatus of claim 1, wherein the first recess includes an ear-receiving opening for receiving a user's ear.

8. The apparatus of claim 1, wherein the first recess is substantially bowl-shaped.

9. The apparatus of claim 1, wherein when a lateral side of a user's head is positioned in the first recess, a lateral side of a user's shoulder is positioned in the second recess, and a lateral side of a user's neck is positioned in the third recess, the user's head, neck, and spine are in a plane parallel to a surface upon which the user is lying.

10. An apparatus for supporting the head and neck of a user in a lateral decubitus position to align and maintain a user's head and neck in the lateral sniff position, comprising:

a front surface;

a rear surface opposite the front surface;

a left side surface;

a right side surface opposite the left side surface;

a bottom surface;

a top surface opposite the bottom surface;

a first recess formed in the top surface and having a chin supporting area for supporting a lateral side of a user's chin, a face supporting area for supporting a lateral side of a user's face, and a back portion supporting area for supporting a lateral side of a back portion of a user's head;

a second recess formed in the top surface and having a channel with a surface that extends from the front surface to the first recess for supporting a lateral side of a user's neck, wherein the channel is positioned at an angle with respect to the front surface such that when a lateral side of a user's neck is positioned on the surface of the channel, the lower cervical spine of a user is maintained in a position of substantially maximal forward flexion; and wherein the chin supporting area of the first recess is positioned at an angle with respect to the channel such that when a lateral side of a user's head is positioned in the first recess, the upper cervical spine of a user is maintained in a position of substantially maximal extension to align and maintain a user's head and neck in the lateral sniff position.

11. The apparatus of claim 10, wherein the top surface has a left side that slopes downwardly from the left side surface toward a center of the top surface and a right side surface that slopes downwardly from the right side surface toward the center of a top surface.

12. The apparatus of claim 10, wherein the first recess has a lowermost surface and the second recess has a lowermost surface, and the lowermost surface of the second recess is above the lowermost surface of the first recess.

13. The apparatus of claim 10 further comprising a third recess formed in the top surface that extends from a side of the first recess to facilitate a user's breathing when a user is lying on his or her side and a lateral side of a user's head is positioned in the first recess.

14. The apparatus of claim 10, wherein the back portion supporting area of the first recess is approximately twice as deep as the face supporting area of the first recess.

15. The apparatus of claim 14, wherein the depth of the chin supporting area is approximately 0.75 inches, the depth of the face supporting area is approximately 0.5 inches, and the depth of the back portion supporting area is approximately 1.0 inch.

16. The apparatus of claim 10, wherein the first recess includes a sloped side wall in the chin supporting area that prevents a user's chin from falling toward his or her chest.

17. The apparatus of claim 10, wherein the first recess includes a sloped side wall in the back portion supporting area that prevents a back portion of a user's head from falling toward his or her back.

18. The apparatus of claim 10, wherein the first recess includes an ear-receiving opening for receiving a user's ear.

19. The apparatus of claim 10, wherein the first recess is substantially bowl-shaped.

20. The apparatus of claim 10, wherein when a lateral side of a user's head is positioned in the first recess, a lateral side of a user's shoulder is positioned in the second recess, and a lateral side of a user's neck is positioned in the third recess, the user's head, neck, and spine are in a plane parallel to a surface upon which the user is lying.

* * * * *